US007066464B2

(12) United States Patent
Blad et al.

(10) Patent No.: US 7,066,464 B2
(45) Date of Patent: Jun. 27, 2006

(54) AUTOMATIC CARD SHUFFLER

(76) Inventors: Steven J. Blad, 51 Pine Isle Ct., Henderson, NV (US) 89074; Lynn C. Hessing, 3155 McCormick Way, Boise, ID (US) 83709; Tyson K. Adams, 202 Black Eagle Ave., Henderson, NV (US) 89015; Kenneth R. Dickinson, 8344 Viceroy La., Las Vegas, NV (US) 89117; Carl Ketcham, 619 W. 5850 South, Murray, UT (US) 84123; Tom Wing, 3435 W. Haleh, Las Vegas, NV (US) 89141

( * ) Notice: Subject to any disclaimer, the term of this patent is extended or adjusted under 35 U.S.C. 154(b) by 0 days.

(21) Appl. No.: 10/765,413

(22) Filed: Jan. 26, 2004

(65) Prior Publication Data

US 2005/0110211 A1 May 26, 2005

Related U.S. Application Data

(63) Continuation-in-part of application No. 10/226,394, filed on Aug. 23, 2002, now Pat. No. 6,698,756.

(51) Int. Cl.
*A63F 1/12* (2006.01)

(52) U.S. Cl. ..... 273/149; 273/292; 463/12; 463/13

(58) Field of Classification Search ..... 273/249, 273/292; 463/12, 13
See application file for complete search history.

(56) References Cited

U.S. PATENT DOCUMENTS 2,755,090 A * 7/1956 Aldrich ..... 273/149 R
3,589,730 A 6/1971 Slay
4,310,160 A * 1/1982 Willette et al. ..... 273/149 R
4,497,488 A * 2/1985 Plevyak et al. ..... 273/149 R
4,512,580 A * 4/1985 Matviak ..... 273/148 A
4,515,367 A 5/1985 Howard
4,586,712 A * 5/1986 Lorber et al. ..... 273/149 R
4,659,082 A 4/1987 Greenberg
4,770,421 A 9/1988 Hoffman
4,807,884 A 2/1989 Breeding
5,275,411 A 1/1994 Breeding
5,303,921 A 4/1994 Breeding
5,356,145 A * 10/1994 Verschoor ..... 273/149 R
5,584,483 A * 12/1996 Sines et al. ..... 273/149 R
5,676,372 A 10/1997 Sines et al.
5,718,427 A 2/1998 Cranford et al.
6,019,368 A * 2/2000 Sines et al. ..... 273/149 R
6,068,258 A 5/2000 Breeding et al.
6,139,014 A 10/2000 Breeding et al.
6,149,154 A 11/2000 Grauzer et al.
6,250,632 B1 * 6/2001 Albrecht ..... 273/149 R
6,254,096 B1 7/2001 Grauzer et al.

(Continued)

*Primary Examiner*—Eugene Kim
*Assistant Examiner*—Dolores Collins
(74) *Attorney, Agent, or Firm*—Rob L. Phillips; Greenberg Traurig

(57) ABSTRACT

Method of optimizing shuffling of cards with a shuffling machine relying on random ejection technology. Deterministic ejection of cards, verifying card stack position and number of cards remaining in a card stack, adjusting operational functions, including low-impact ejection and packer arm activation, and automatic analysis of card quality create an optimum system for shuffling cards using a shuffler which incorporates random ejection technology. A calibration procedure facilitates the optimization features. In another embodiment, multiple buttons or a single button provide means for an operator to navigate a list of menu items and select a desired menu item.

20 Claims, 14 Drawing Sheets

U.S. PATENT DOCUMENTS

| | | | | |
|---|---|---|---|---|
| 6,299,167 | B1 | 10/2001 | Sines et al. | |
| 6,325,373 | B1 | 12/2001 | Breeding et al. | |
| 6,582,301 | B1 | 6/2003 | Hill | |
| 6,659,460 | B1 * | 12/2003 | Blaha et al. | 273/149 R |
| 6,698,756 | B1 * | 3/2004 | Baker et al. | 273/149 R |
| 6,719,288 | B1 * | 4/2004 | Hessing et al. | 273/149 R |
| 6,959,925 | B1 * | 11/2005 | Baker et al. | 273/149 R |
| 2002/0017481 | A1 | 2/2002 | Johnson et al. | |
| 2002/0063389 | A1 | 5/2002 | Breeding et al. | |
| 2002/0163125 | A1 | 11/2002 | Grauzer et al. | |
| 2003/0042673 | A1 | 3/2003 | Grauzer et al. | |
| 2003/0052449 | A1 | 3/2003 | Grauzer et al. | |
| 2003/0052450 | A1 | 3/2003 | Grauzer et al. | |
| 2003/0073498 | A1 | 4/2003 | Grauzer et al. | |
| 2003/0075866 | A1 | 4/2003 | Blaha et al. | |
| 2003/0090059 | A1 | 5/2003 | Grauzer et al. | |
| 2003/0094756 | A1 | 5/2003 | Grauzer et al. | |

* cited by examiner

AUTOMATIC CARD SHUFFLER

CROSS REFERENCE TO RELATED APPLICATIONS

This application is a continuation-in-part of application Ser. No. 10/226,394 filed Aug. 23, 2002, now U.S. Pat. No. 6,698,756.

FIELD OF THE INVENTION

The present invention relates to devices for shuffling playing cards for facilitating the play of casino wagering games. More particularly, an electronically controlled card shuffling apparatus includes a card input unit for receipt of an unshuffled stack of playing cards, a card ejection unit, a card separation and delivery unit and a collector unit for receipt of shuffled cards.

BACKGROUND

Automatic card shuffling machines were first introduced by casinos approximately ten years ago. Since then, the machines have, for all intents and purposes, replaced manual card shuffling. To date, most automatic shuffling machines have been adapted to shuffle one or more decks of standard playing cards for use in the game of blackjack. However, as the popularity of legalized gambling has increased, so too has the demand for new table games utilizing standard playing cards. As a result, automatic shuffling machines have been designed to now automatically "deal" hands of cards once the cards have been sufficiently rearranged.

For example, U.S. Pat. No. 5,275,411 ("the '411 patent") to Breeding and assigned to Shuffle Master, Inc., describes an automatic shuffling and dealing machine. The '411 patent describes an automatic method of interleaving cards as traditionally done in a manual fashion. Once interleaved, the entire stack of shuffled cards is positioned above a roller that removes and expels a predetermined number of cards from the bottom of the stack to a card shoe. Once the predetermined number of expelled cards are removed from the shoe by a dealer, a second set of cards is removed and expelled. This is repeated until the dealer has dealt each player his or her cards and has instructed (e.g. pressed a button on the shuffler) the shuffling machine to expel the remaining cards of the stack.

The '411 patent and related shufflers, having a dealing means, suffer from the same shortcomings—slowness, misdeals and failure. However, the machines currently marketed are still favored over manual card shuffling. On the other hand, since casino revenue is directly proportional to the number of plays of each wagering game on its floor, casinos desire and, in fact, demand that automatic card shufflers work quickly, reliably and efficiently.

Accordingly, the present invention utilizes a proprietary random card ejection technique in combination with a novel card separation and delivery unit to overcome the aforementioned shortcomings. The present invention uses random ejection technology to dispense individual cards from a card input unit to a card separation and delivery unit of the shuffler. A card stop arm and floating gate control the number of ejected cards that may, at any one time, travel to the card separation and delivery unit. The ejected cards are then separated by a feed roller system which propels the cards to a collection unit. Once a predetermined number of cards are propelled to the collection unit, additional cards are ejected from the card input unit. A shuffler processing unit in communication with internal sensors controls the operation of the shuffler.

An audio system is adapted to communicate internal shuffler problems and shuffler instructions to an operator. Preferably, the audio system is controlled by the shuffler processing unit in communication with a second local processing unit.

SUMMARY

While the objects of the present invention are too numerous to list, several objects are listed herein for reference.

A principal object of the present invention is to provide a reliable and quick card shuffler for poker style card games.

Another object of the present invention is to provide operators with audio outputs of the shuffler's status during use.

Another object of the present invention is to provide operators with audio outputs of shuffler instructions during shuffler use.

Another object of the present invention is to utilize random ejection technology in a shuffler having a means for delivering card hands.

Another object of the present invention is to provide a shuffler having a card delivery means that infrequently, if ever, misdeals (e.g. deal four cards instead of three) or jams.

Another object of the present invention is to decrease the time wasted between deals of any card-based table game.

Another object of the present invention is to provide a shuffler eliminating the need to shuffle an entire deck of cards for each play of the underlying game.

Another object of the present invention is to provide a shuffler having means for accepting and delivering cards of multiple sizes.

Yet another object of the present invention is to provide a shuffler that can deliver card hands of multiple size (e.g. card hands of two to seven cards).

Yet another object of the present invention is to optimize the operation of the shuffler.

Other objects will become evident as the present invention is described in detail below.

The objects of the present invention are achieved by a shuffler having a card input unit for receipt of unshuffled stacks of playing cards, a card ejection unit, a card separation and delivery unit, a delivery unit and a collection unit for receipt of shuffled cards.

The card input unit is positioned at the rear of the shuffler and adjacent to three card ejectors that randomly push single cards from the unshuffled stack of cards. The input unit is mounted on an output shaft of a linear stepper motor in communication with a shuffler microprocessor. The stepper motor randomly positions a tray of the card input unit with respect to the fixed card ejectors. Each ejector is then activated in a random order such that three cards are ejected from the deck. Once the three cards are ejected, the card input tray is randomly re-positioned, and the three ejectors are once again activated. This process continues until the necessary number of cards for two hands of the underlying game is ejected. The movement of the ejected cards is facilitated by ejection rollers and a downwardly inclined card-traveling surface leading to a collection point, where ejected cards stack behind a stop arm.

The partially rotatable stop arm is spring loaded such that a first end opposite the fixed rotatable end applies pressure in a downward direction onto the card-traveling surface having two parallel card separation belts. The arm is controlled by a motor and cam arrangement that acts to intermittently raise the first end of the stop arm to allow a predetermined number of cards to pass through to the card separation and delivery unit.

The card separation and delivery unit includes a separation belt system, separation rollers and a floating gate. The separation belt system is comprised of two parallel belts residing in a cut-out portion of the card-traveling surface. The separation rollers are above said belts and clutch the cards while the belts remove cards from the bottom of the stack one at time. A floating gate is supported by an elongated member having a first end joined to a first shaft supporting said separation rollers and a second end joined to a second more forward parallel shaft. The floating gate is spaced above the card-traveling surface just rear of the separation rollers and forward of the stop arm so as to prevent no more than 2 or 3 cards from fully passing under the stop arm thereby minimizing misdeals or card jams. A protrusion extending from a bottom portion of the floating gate head is spaced above the card-traveling surface a minimum distance equivalent to the thickness of several playing cards. The floating gate eliminates heretofore common jam and misdeal occurrences. In the unlikely event of a card jam or misdeal, the present shuffler is equipped with multiple internal sensors for detecting the same. Moreover, the sensors are preferably in communication with an audio output system which alerts the operator of the jam or misdeal. In addition, the audio system may be used to instruct an operator during use of the shuffler.

Once the cards are propelled forward by the separation belts, the cards encounter a set of feed rollers. The feed rollers spaced rear of the card collection unit act to feed individual cards into the collection unit. The rotational speed of the feed rollers is faster than the separation belts and rollers so that each card is spaced from the successive card prior to being fed to the collection unit one at a time. The space between the cards is detected by appropriately placed sensors such that the microprocessor stops cards from being fed to the collection unit when a first full hand (e.g. 3, 5, 7 cards) has been collected.

Sensors located in the card collection unit detect the presence of cards in the collection unit. It is from the card collection unit that the operator (e.g. dealer) of the particular card game takes the predetermined number of cards and gives them to a player. Once the cards are removed, sensor outputs cause the microprocessor to instruct the card separation and delivery unit to feed a second hand of cards and the ejector unit to eject another hand of cards. This is repeated until all players have the predetermined number of cards. Once all cards have been ejected and dealt, the operator presses a stop button to cease shuffler operation. Thereafter, once the card game is completed, all dealt cards are placed back on top of the stack of any remaining cards in the card input unit. When ready, the operator presses a go or shuffle button to begin the process for the next game.

Without random ejection technology it has been necessary to expel all cards and re-shuffle all cards for each game played. Therefore, to the delight of players and casinos, the random ejection technology and other features of the present invention dramatically speed up the play of all card games.

BRIEF DESCRIPTION OF THE DRAWINGS

It should be understood that all drawings reflect the present invention with a housing removed.

DETAILED DESCRIPTION

Figure 1:
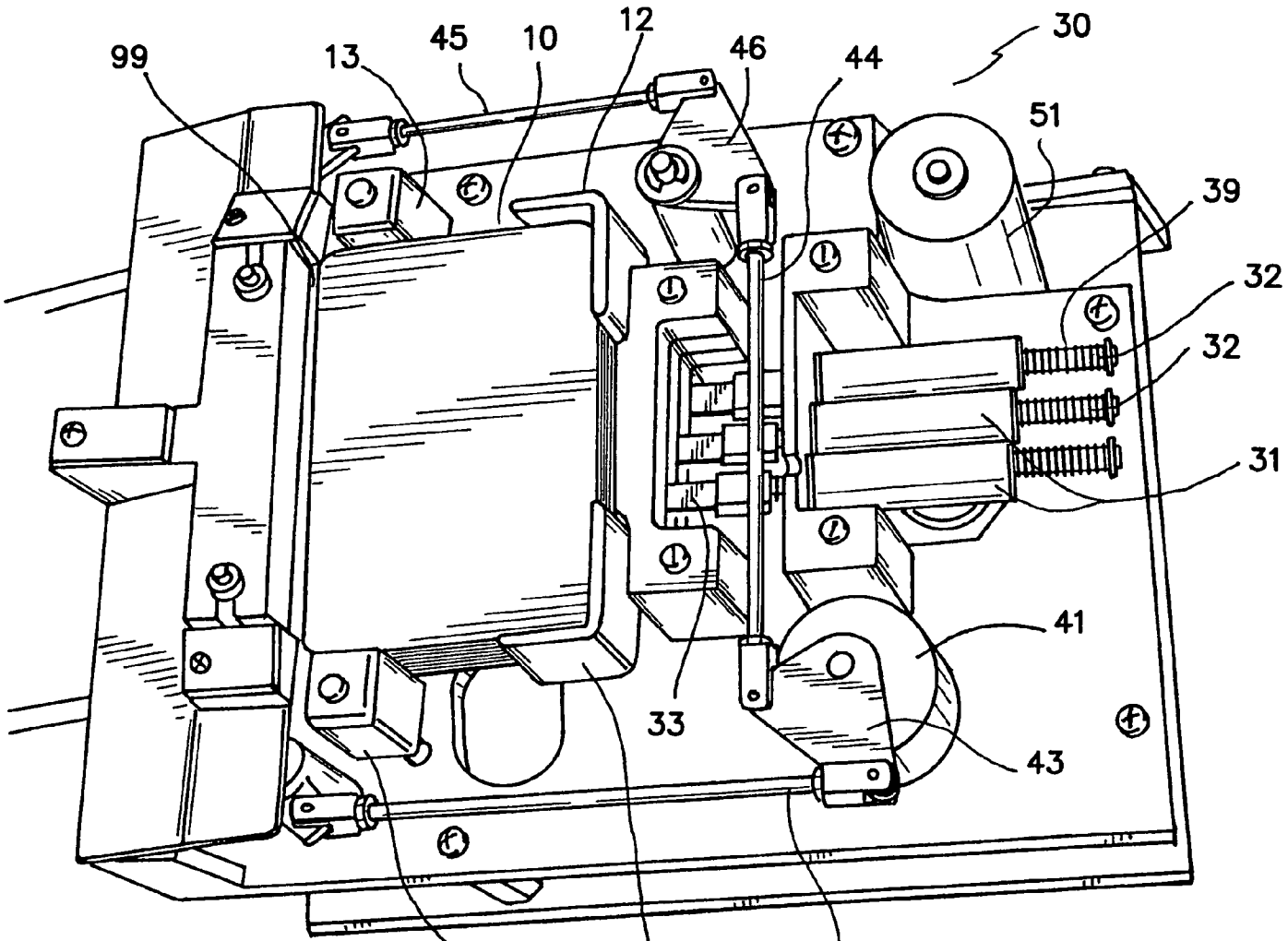
FIG. 1 is a perspective top view of an ejection unit of the present invention.
Figure 1A:
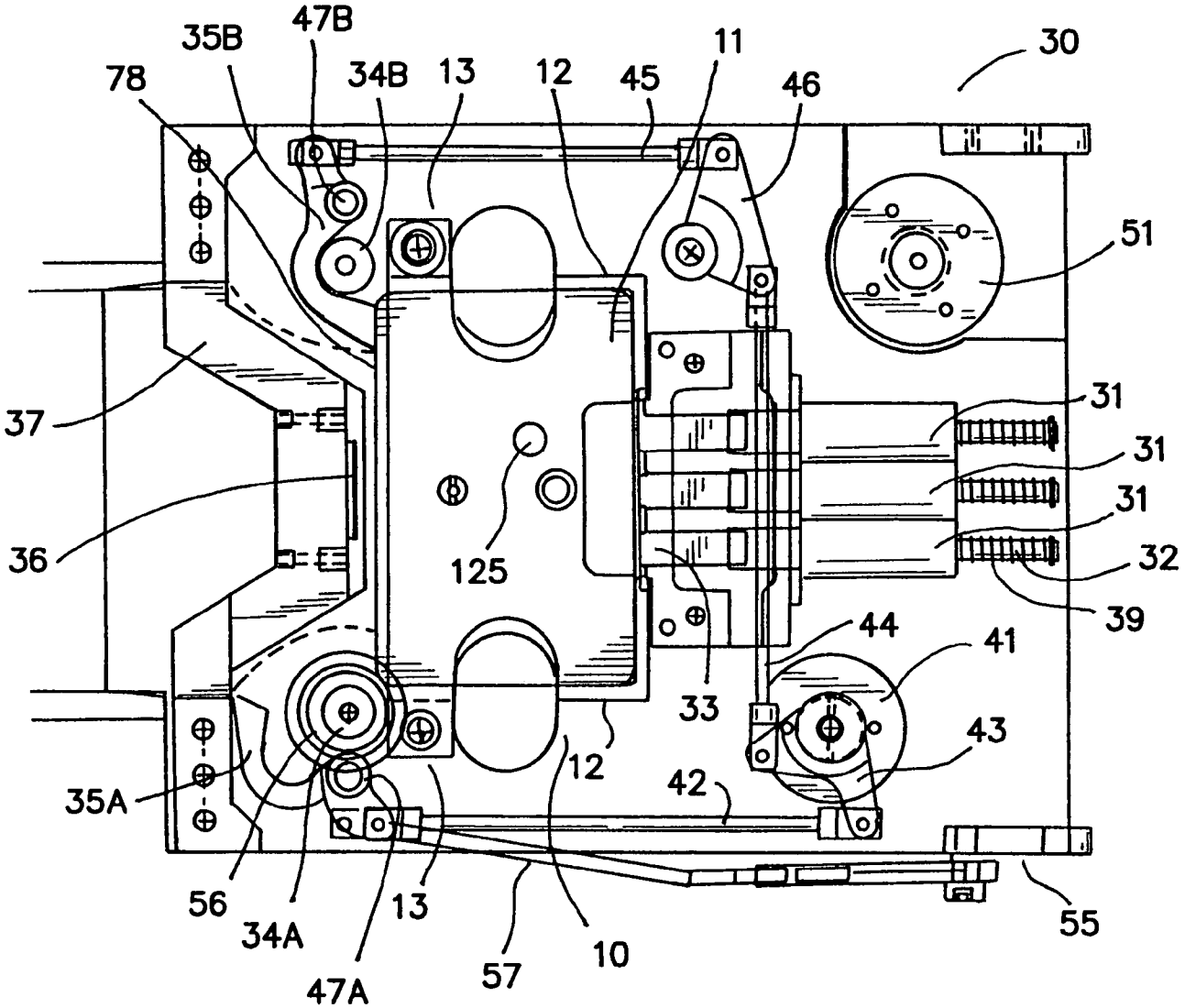
FIG. 1A is a top view of the ejection unit showing internal features of the present invention.

Reference is now made to the figures wherein like parts are referred to by like numerals throughout. FIG. 1 shows an automatic card ejection unit of a card shuffler. In practice, the card shuffler includes a housing to protect and conceal the internal components of the shuffler. The housing includes one or more access points for inputting cards, clearing card jams and for routine service and maintenance procedures. Moreover, the housing includes various operator input means including buttons, switches, knobs, etc., to allow the operator to interact with the shuffler. For example, an on-off button and stop and go buttons will be integrated within said housing.

It should be understood that all operations of the shuffler are controlled by an internal processing unit. Preferably, the processing unit is a microprocessor of the kind known in the art. The shuffler microprocessor is attached to a standard printed circuit board along with other electronic components (e.g. resistors, capacitors, etc.) necessary to support the microprocessor and its operations. The use of a microprocessor to control machines of all types is well-known in the art, and therefore, the specific details are not reiterated herein.

FIGS. 1–4 illustrate a card input unit 10 and card ejection unit 30 of the shuffler. Other shuffler units include a card separation and delivery unit 70 and a collection unit 110 (as shown in FIGS. 5–8A). As referred to throughout, the rear of the shuffler is defined by the card input unit 10 and ejection unit 30 and the front of the shuffler is defined by the collection unit 110.

Figure 2:
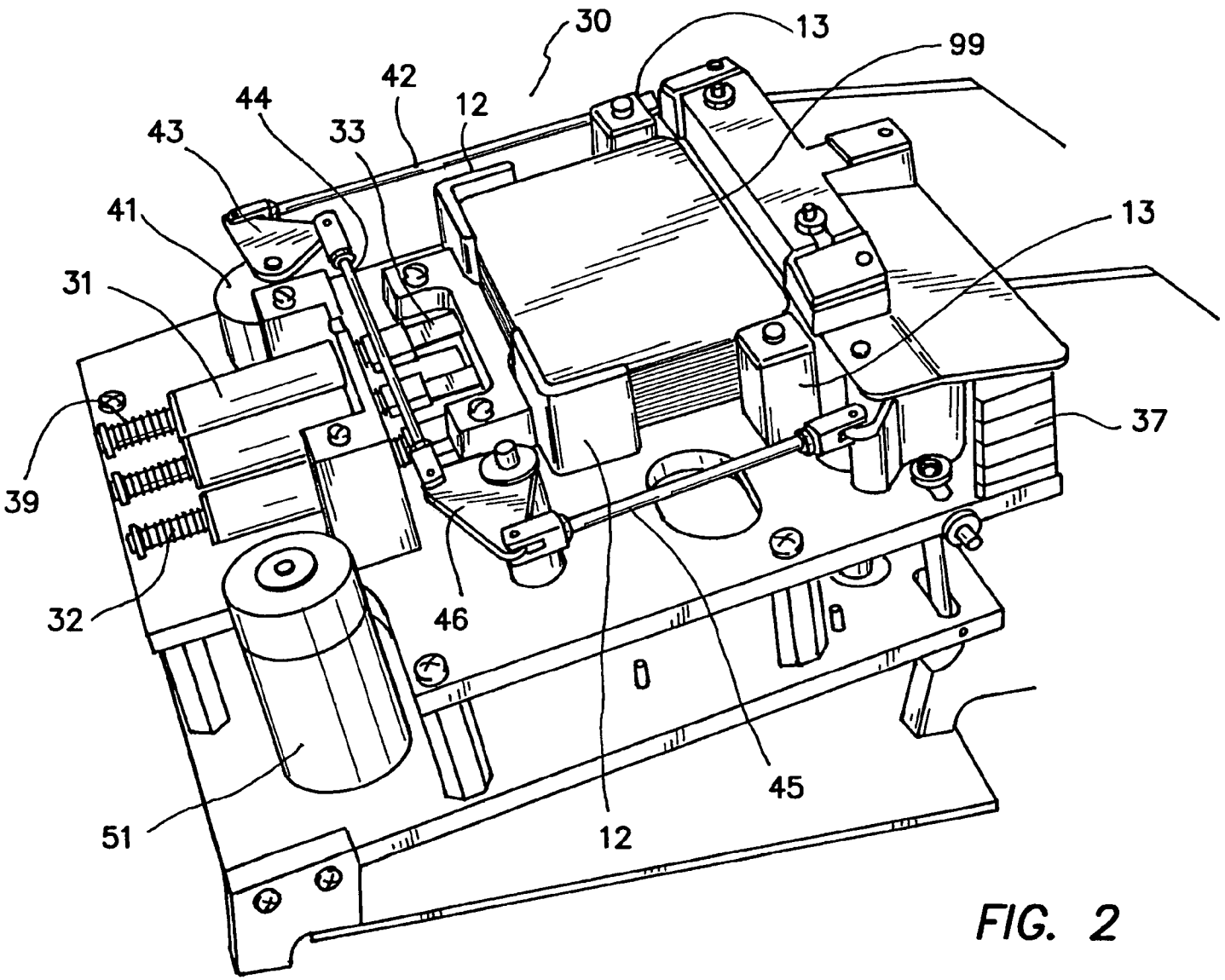
FIG. 2 is a right side view of the present invention showing a card input unit and a card ejection unit.
Figure 3:
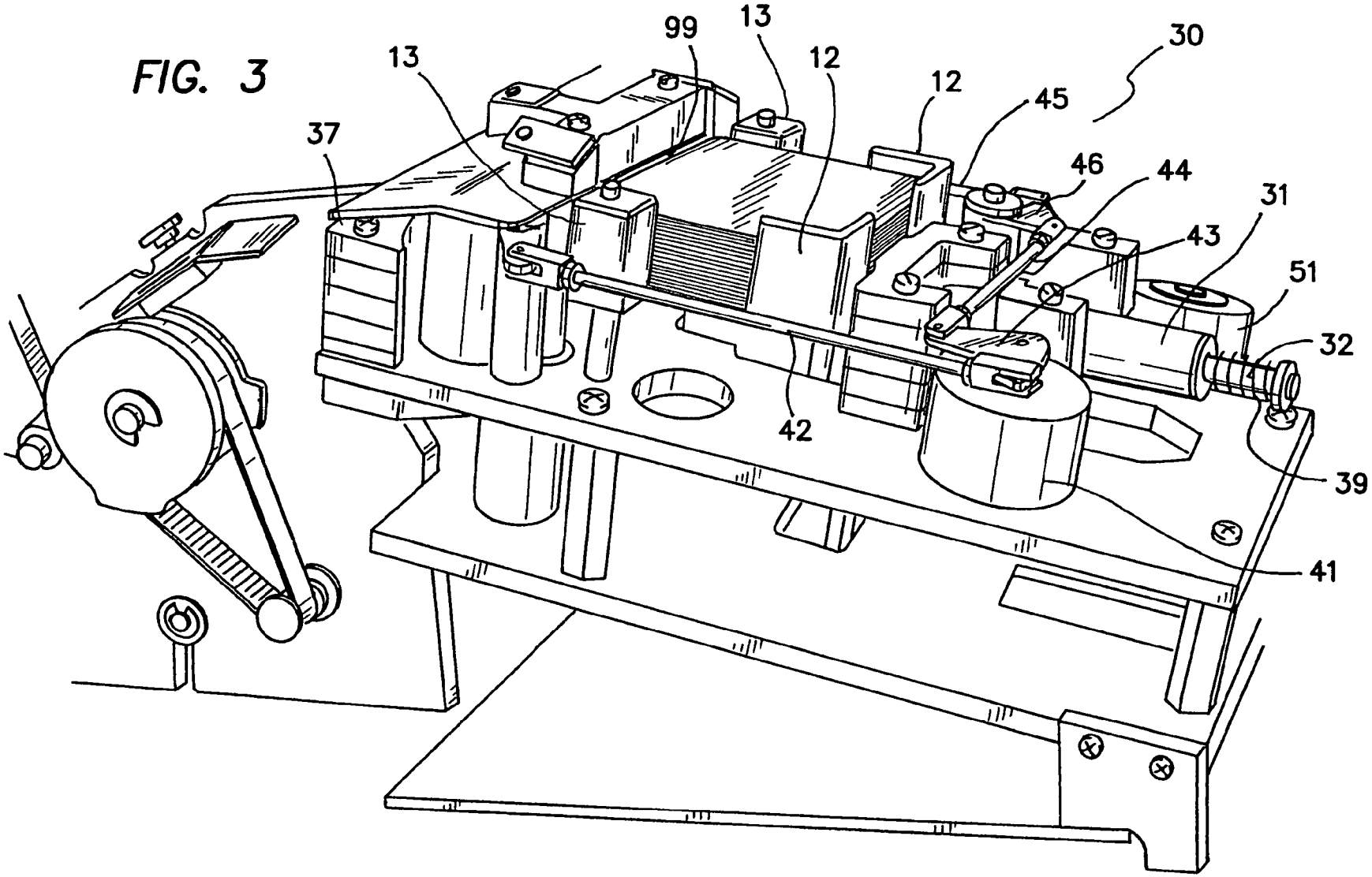
FIG. 3 is a left side view of the present invention showing the card input unit and the card ejection unit.

The card input unit 10 comprises a tray 11 having two vertical angled walls 12 and two oppositely placed pillars 13 attached thereto. A stack of cards is initially placed into a recess defined by the angled walls 12 and the pillars 13. As illustrated in FIG. 2, the card input unit 10, more particularly, the underside of the tray 11, is attached to an output arm or load screw of a linear stepper motor (not shown). The linear stepper motor randomly raises and lowers the card input unit 10 for reasons that will be fully described below.

U.S. Pat. Nos. 5,584,483 and 5,676,372 assigned to the predecessor in interest of the same assignee as the instant application are incorporated herein by this reference and provide specific details of the random ejection technology implemented in the present invention. The ejection unit 30 comprises three solenoids 31 driving three plungers 32 incorporating ejector blades 33. The solenoids 31 and corresponding ejector blades 33 are each placed at different heights to the rear of the card input unit 10.

Once a stack of cards is loaded into the card input unit 10, an operator presses an external go, deal, shuffle or start button to begin the ejection, separation and delivery process. A card ejecting process begins with the card input unit 10 being raised or lowered to a random location by the linear stepper motor. The random location of the card input unit 10 is based on a random number generated by the shuffler microprocessor or an independent random number generator. An optical sensor insures that the card input unit 10 remains within predetermined maximum and minimum upper and lower input unit 10 positions. Once the card input unit 10 reaches a random location and stops, the solenoids 31 are activated one at a time causing the ejector blades 33 to project into the previously loaded stack of cards. Each blade 33 is designed to eject a single card from the stack. The solenoids 31 are spring biased by springs 39 such that the ejector blades 33 automatically return to their original position after ejecting a card. Upon being ejected from the deck, each ejected card is assisted to the card separation and delivery unit 70 by two oppositely placed roller mechanisms 34A, 34B. To enhance the operation of the card ejection unit 30, a mass or force is applied to a top of the card stack to maintain the cards in a tightly stacked arrangement. The applied mass or force eliminates concerns over bent or otherwise damaged cards which can cause separations in the stack. The separations tend to reduce the effectiveness of the ejector blades 33.

As stated above, the precise operation of the ejection device 30 and incorporated random ejection technology is processor controlled. As known in the art, processors rely on instructions, in the form of computer readable medium (i.e., software), to operate. To optimize the operation of a card shuffler employing random ejection technology, the operational software and mechanical components should function in unison. As described in detail below, certain software driven features facilitate an optimum random ejection device 30 of the kind described herein and in U.S. Pat. Nos. 5,584,483 and 5,676,372 and any future shuffler designs.

Figure 4:
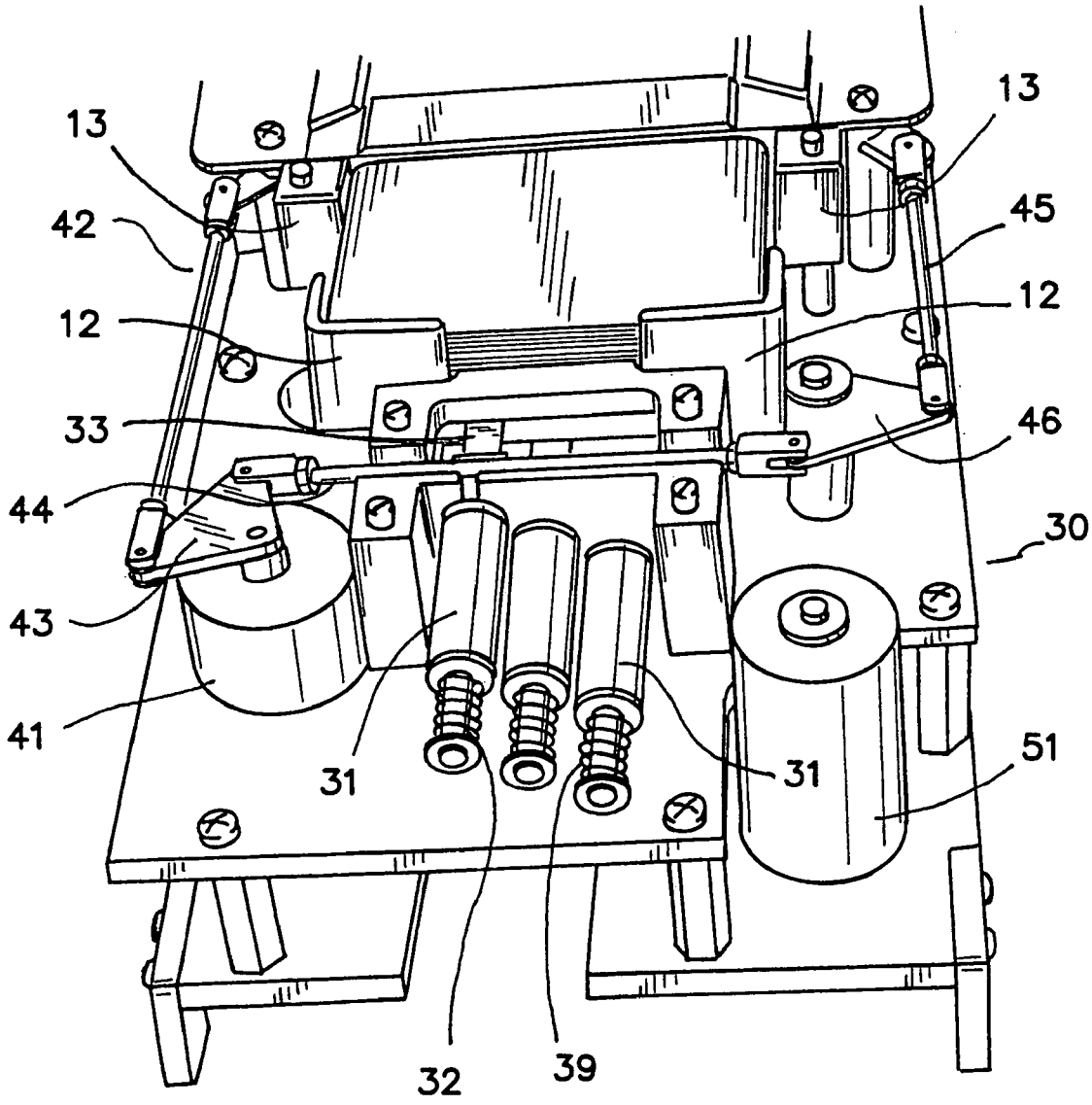
FIG. 4 is a rear view of the present invention showing the card input unit and the card ejection unit.
Figure 4A:
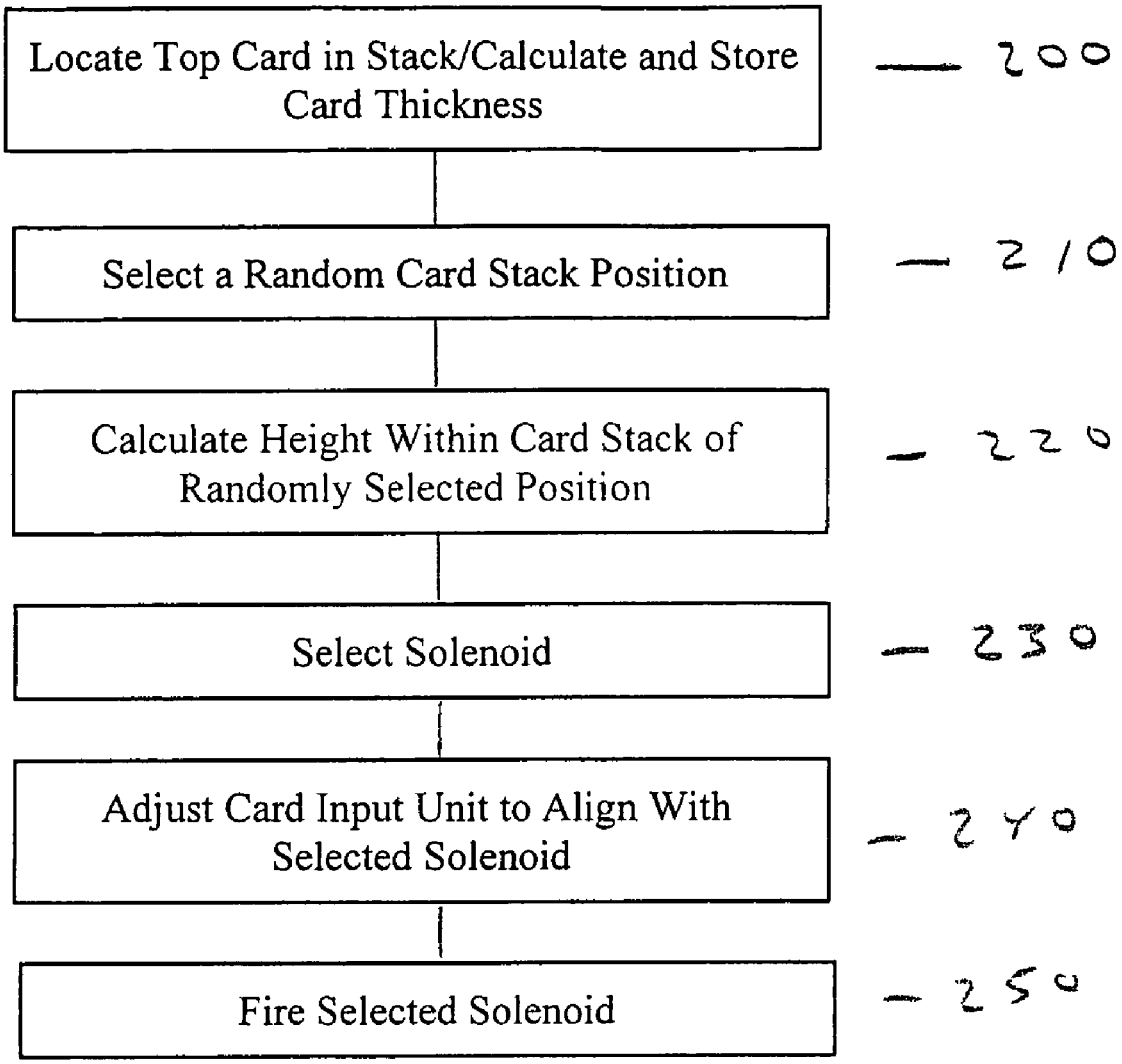
FIG. 4A is a flow chart detailing a deterministic dealing method.
Figure 4B:
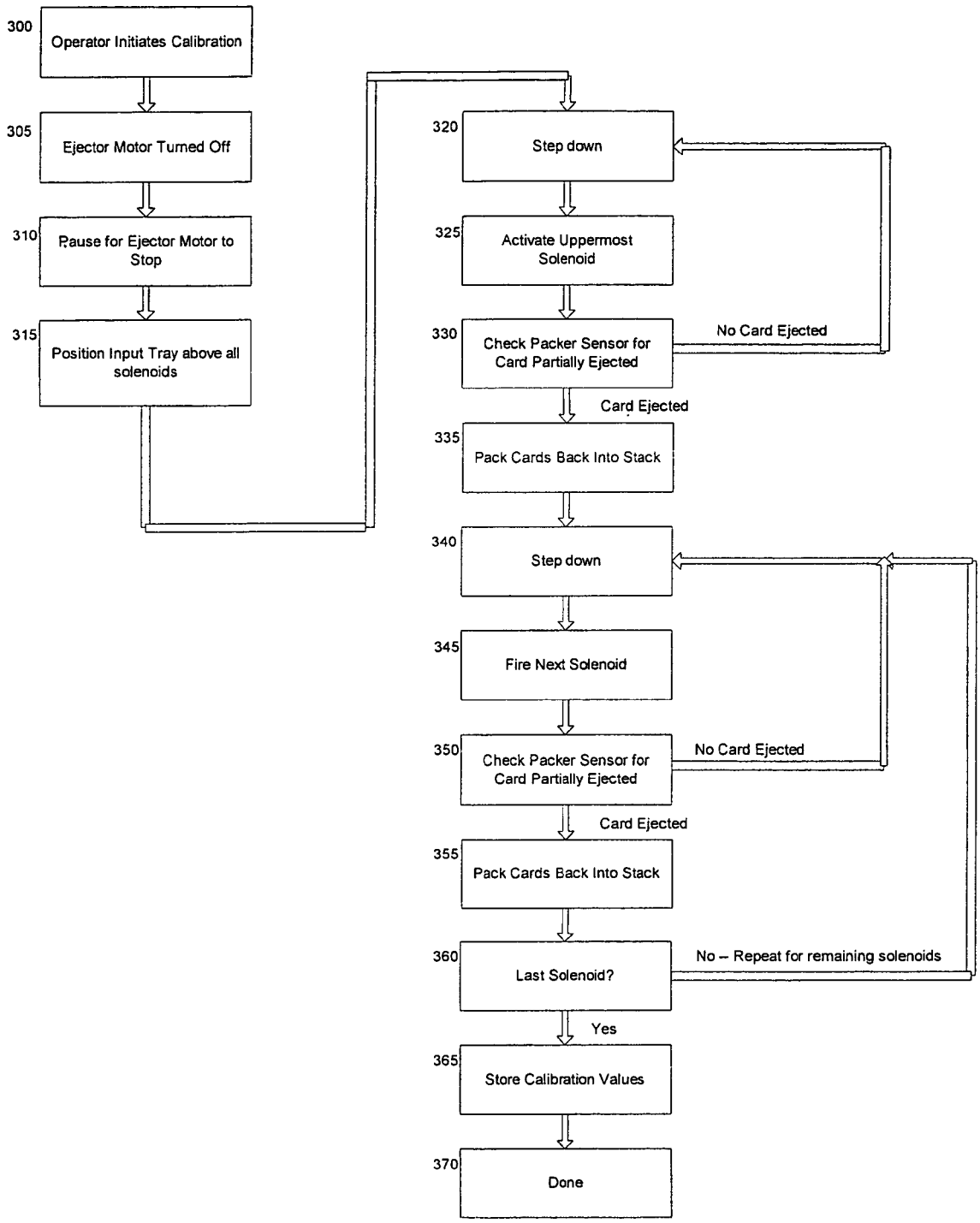
FIG. 4B is a flow chart of a calibration procedure.

A first optimization feature comprises a method of deterministic ejection. The deterministic approach relies on firing a single ejector blade each time the card input unit 10 is positioned. This is contrary to firing each of three ejector blades at each card input unit 10 location as disclosed above. The method, as illustrated by the flow chart of FIG. 4A, comprises, at step 200, locating a top of the card stack in the card input unit 10, and using the position of the top of the card stack, combined with a height of the stack, to calculate and store, in a memory device of the shuffler, a card thickness. Then, at step 210, selecting a random position, corresponding to a single card, from the remaining card stack in the card input unit 10. At step 220, a height of the random position or card within the card stack is calculated by multiplying the number of cards underneath the randomly selected card by an average card thickness. Varying average card thicknesses may be stored in a shuffler's memory device to account for different card types and/or brands or may be measured during the shuffle as described in relation to step 200. Once the height is determined, at step 230, a specific one of the solenoids 31 closest in proximity to the random position is selected. Then, at step 240, the card input unit 10 is positioned so that the random position or card is aligned with the selected solenoid 31 and corresponding ejector blade 33. At step 250, the selected solenoid 31 is fired thereby directing its corresponding ejector blade 33 into the random card and ejecting, at least partially, the card from the stack.

The deterministic ejection eliminates previously wasted time associated with solenoids being fired in locations void of cards. Now, each fired solenoid has a specific card to eject such that the number of firings and the time to eject the required number of cards from the stack is dramatically decreased. In fact, with the deterministic ejection method, the shuffler is typically able to eject forty-two cards from a 52-card deck in sixteen seconds or less.

Accurate ejection of a selected card is dependent upon knowing the precise location of each of the solenoids 31 relative to the position of the bottom card in the card input unit 10. A routine (e.g., once a week or more or less frequently as needed) calibration procedure ensures that the aforementioned relative solenoid 31 position is accurate in the shuffler's memory or similar device. FIG. 3B details the calibration procedure.

Once a stack of cards is placed in the card input unit 10, at step 300, the operator initiates the calibration procedure by means of a button, switch, menu or other method. At step 305, the ejector motor is turned off causing the roller mechanisms 34A, 34B to disable and, at step 310, a slight pause provides time for the ejector motor to stop completely. At step 315, the card input unit 10 is positioned above all of the solenoids 31 such that the bottom most card in the card input unit 10 is above the uppermost solenoid 31. Next, a loop comprising steps 320, 325 and 330 is repeated until a card is partially ejected. More particularly, at step 320, the card input unit 10 is lowered a pre-established distance, at step 325, the uppermost solenoid 31 is fired and, at step 330, sensors (e.g. packer sensors) detect whether a card has been partially ejected. If not, the steps 320–330 are repeated. If a partially ejected card is detected, at step 335, packer arms 35A, 35B pack the partially ejected card back into the card stack. At steps 340, 345, 350 and 355, the remaining solenoids are calibrated in the same manner until, at step 360, it is determined that all solenoids 31 have been calibrated accordingly. Then, at step 365, the location values for each solenoid 31 are stored in shuffler memory and the procedure ends at step 370. The location values facilitate the deterministic ejection method.

As discussed above, damaged cards can reduce the effectiveness of the ejector unit 30. Although card wear and tear from the ejector blades is minimal, the shuffler is able to monitor the condition of the cards. By tracking the number of times multiple cards are ejected by a single strike of an ejector blade 33 and/or recording the speed of the cards as they are ejected from the card input unit 10, the shuffler can detect when the cards are worn. In one embodiment, the card speed can be calculated by sensing the front edge of the card as it exits the card input unit 10 and also sensing the rear edge of the card as it exits the card input unit 10. The card speed is then calculated by dividing the card width by the time between the front edge sensing and rear edge sensing. Alternative methods may be used as well. Minimum thresholds for both the number of misdeals and card speed are stored in the memory device of the shuffler and compared to the recorded number of misdeals and the card speed, respectively, to determine when the cards are overly worn. Once either, or both, thresholds have been breached, the shuffler notifies the operator that the cards should be replaced. The operator notification may occur via a display, light or similar device.

Even though card wear and tear is not a common problem, the operation of the ejector blades 33 may be controlled such that the wear and tear may be reduced even further or eliminated completely. In a first embodiment, the speed of the ejector blades 33 is controlled via a pulse sent to the corresponding solenoid 31. The speed is such that the ejector blade 33 is moving at an insignificant pace as it nears contact with the card. Then, a second pulse sent to the solenoid 31 causes the blade 33 to generally push the card from the stack rather than ejecting the card from the stack. In this fashion, the force of contact between the blade 33 and card is reduced thereby decreasing or eliminating card wear and tear. Ideally, to eliminate card wear and tear, the solenoid 31 receives the second pulse in concert with the blade 33 contacting the card from the first pulse.

Figure 4C:
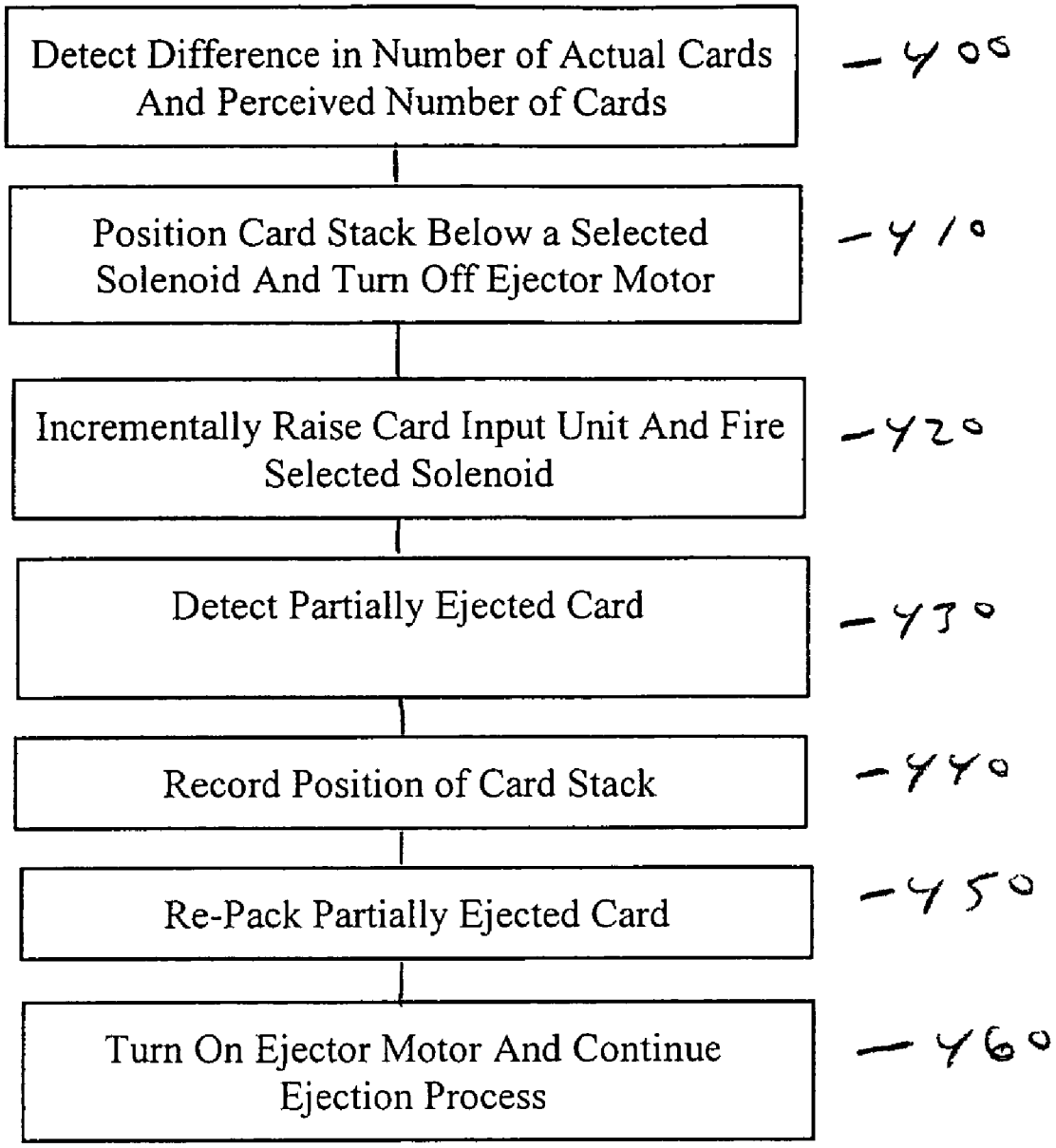
FIG. 4C is a flow chart of an adaptive packing method.
Figure 5:
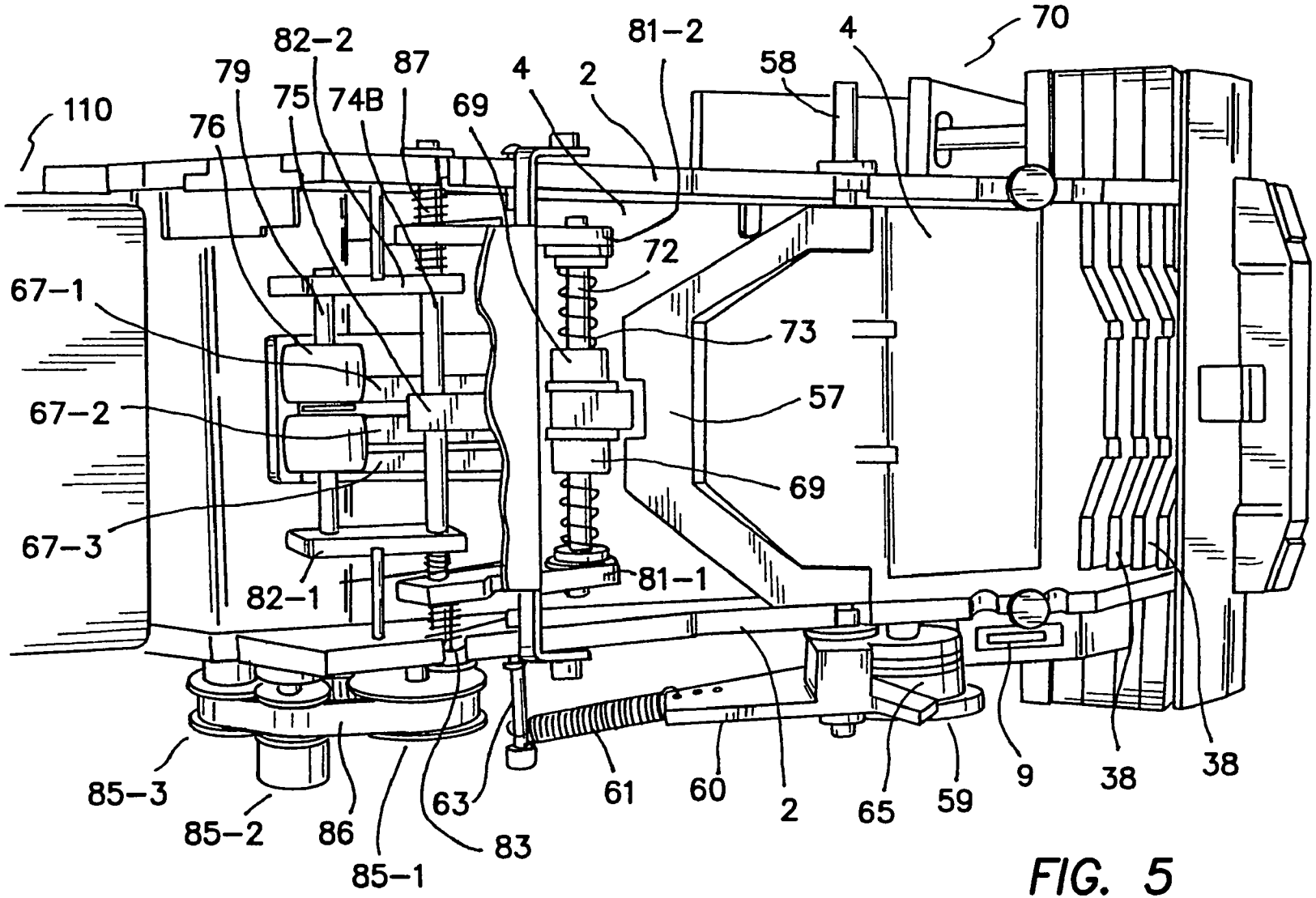
FIG. 5 is a front view of the present invention showing a card separation and delivery unit and a card collection unit.
Figure 6:
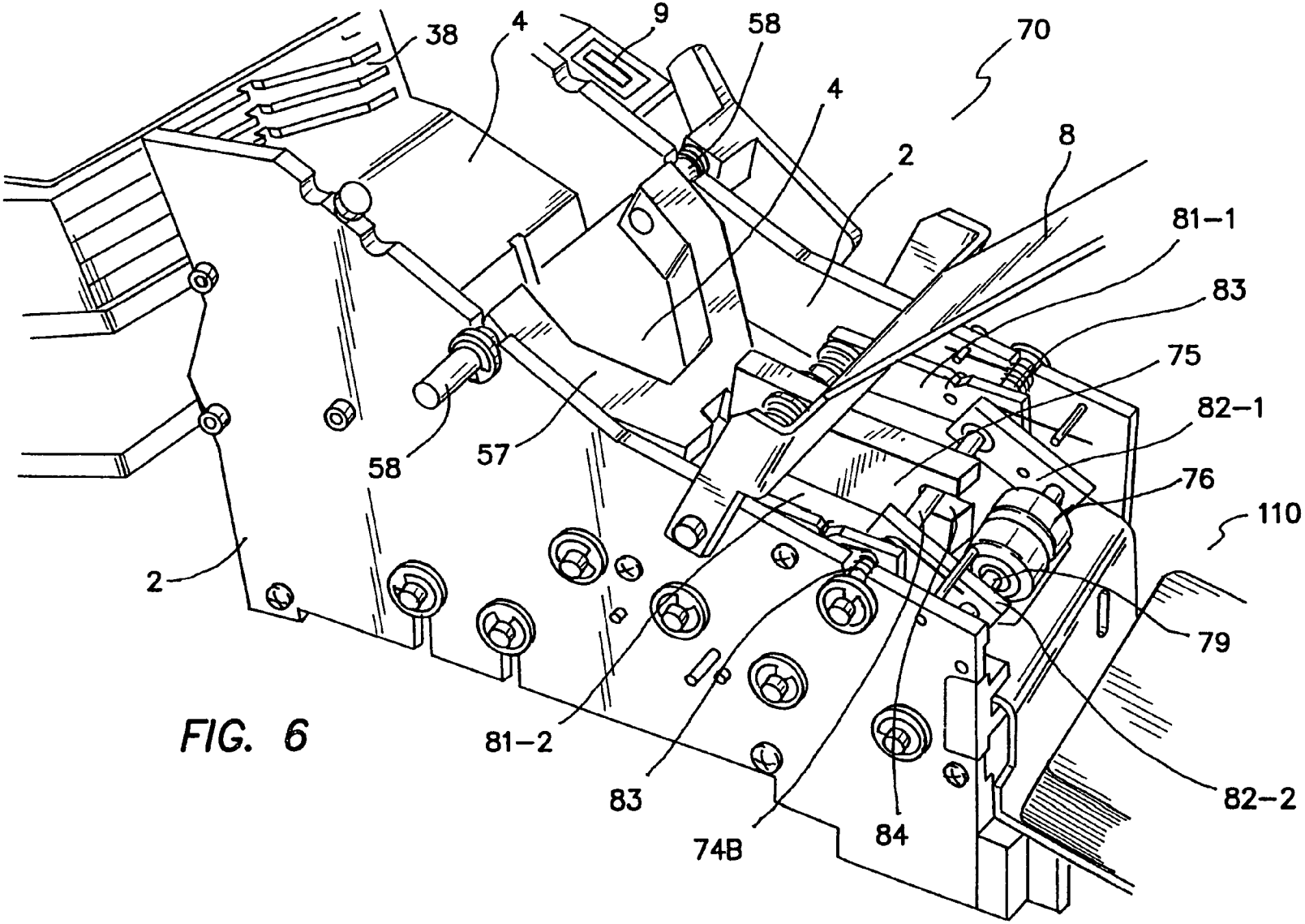
FIG. 6 is a right side view of the present invention showing the card separation and delivery unit and the card collection unit.
Figure 7:
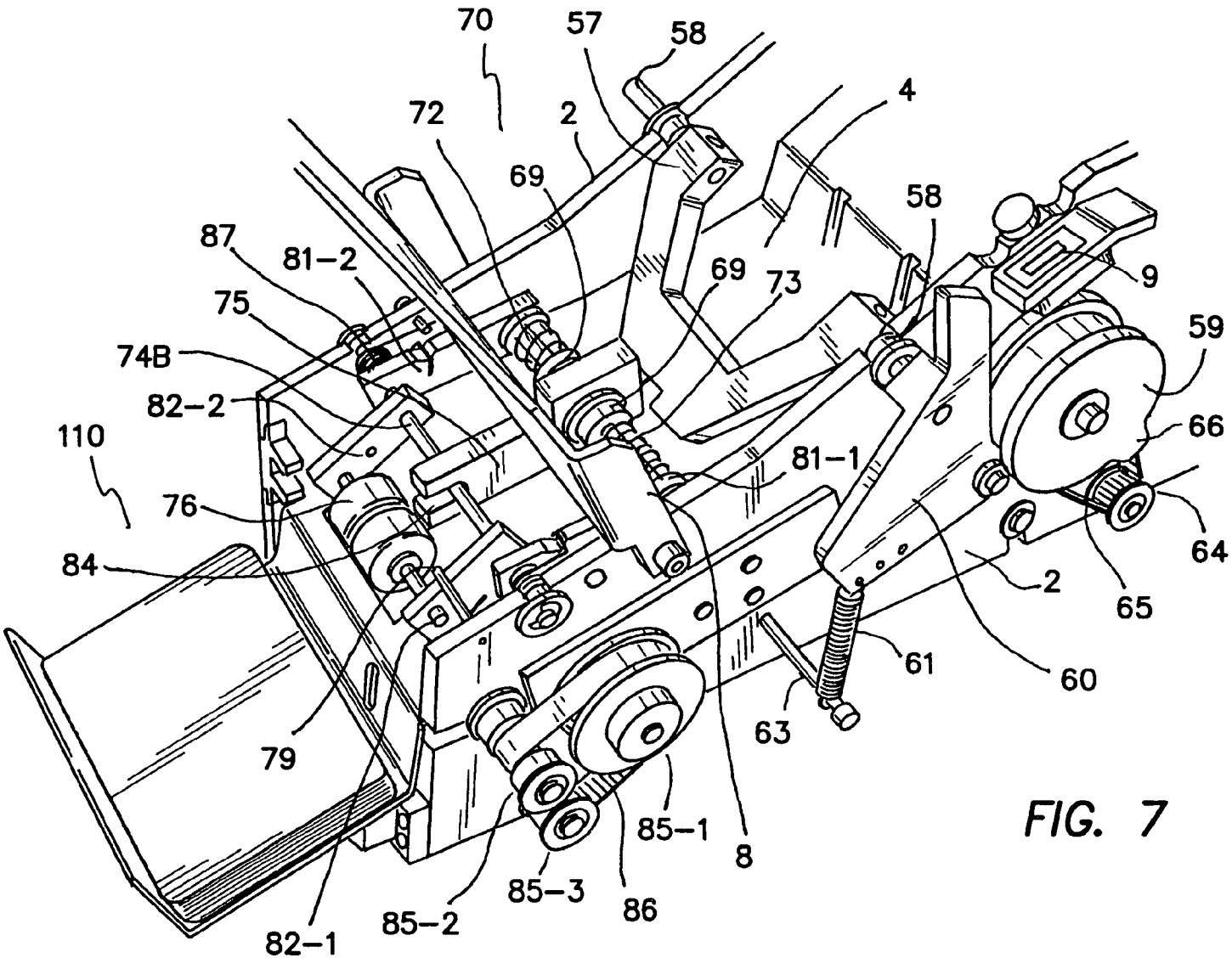
FIG. 7 is a perspective left side view of the present invention showing the card separation and delivery unit and the card collection unit.
Figure 8:
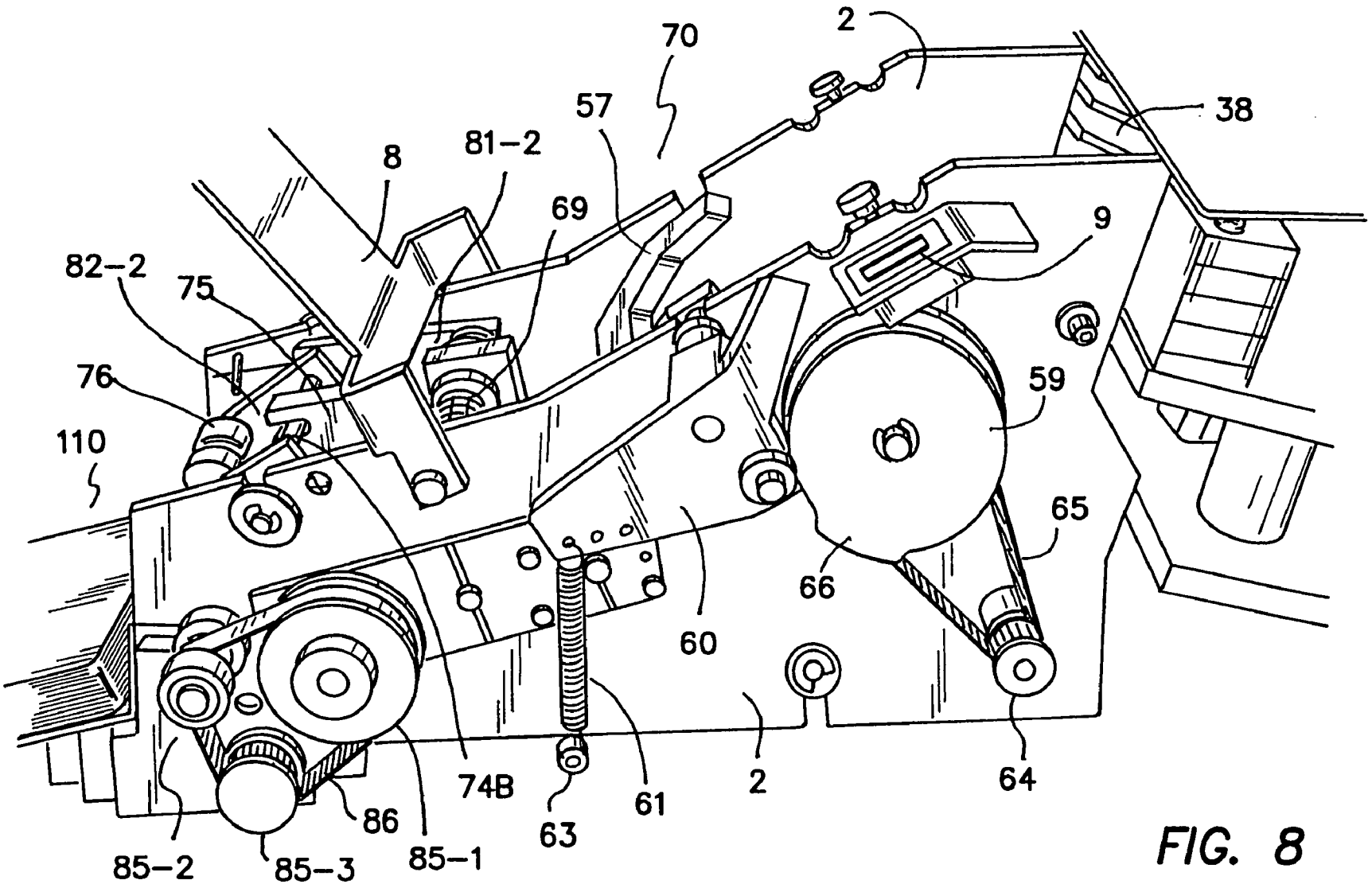
FIG. 8 is a left side view of the present invention showing the card separation and delivery unit and the card collection unit.
Figure 8A:
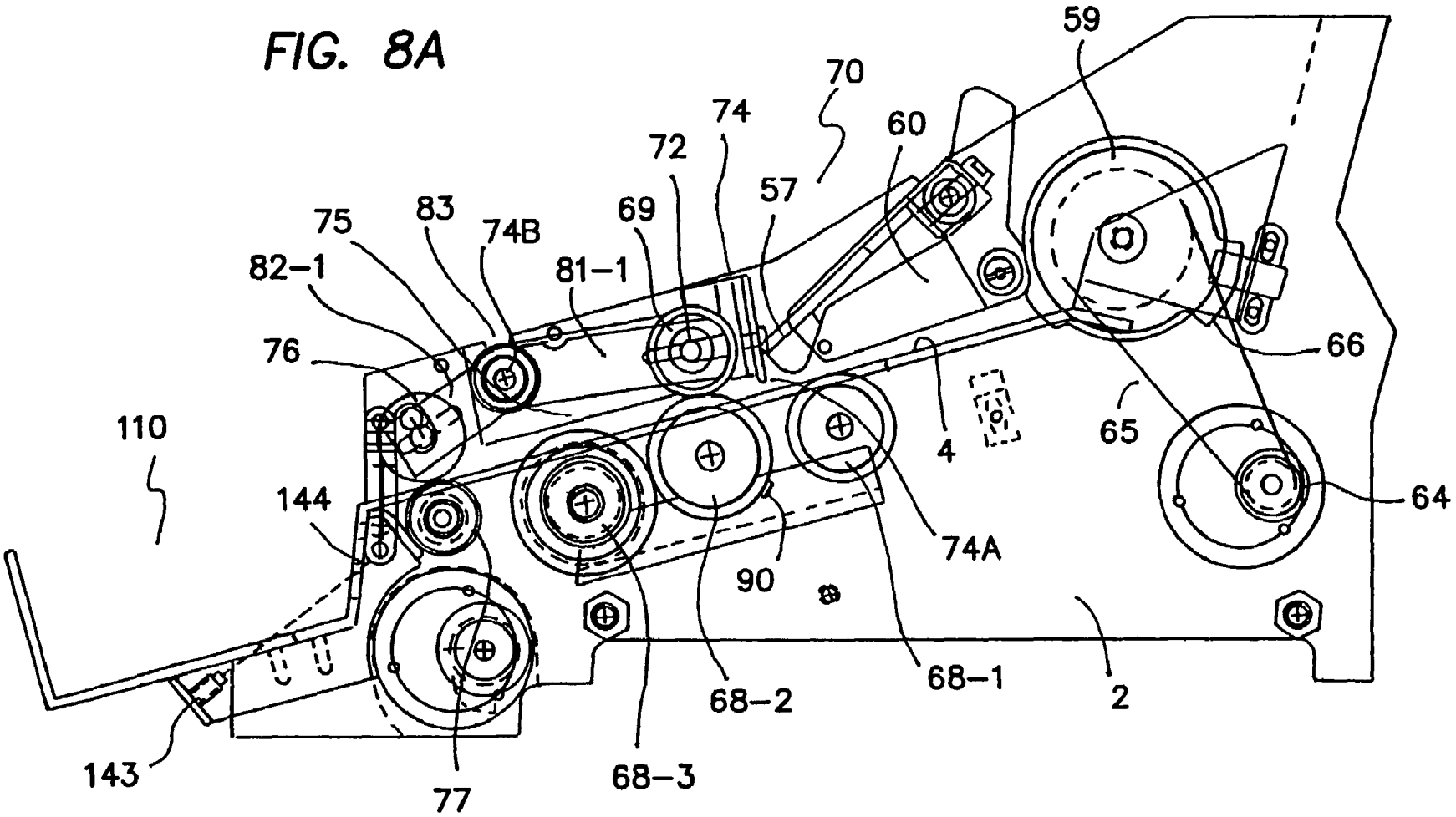
FIG. 8A is a left side view showing internal features of the present invention.

In practice, the actual number of cards remaining in the stack in the card input unit 10 may be different than the number perceived by the shuffler. This may be the result of, among other things, multiple cards being ejected by a single strike of a blade 33. In such situations the number of cards in the card stack is less than the number the shuffler believes should be there. Regardless of the reason for the difference in the actual and perceived number of cards, an adaptive method, as illustrated in the flow chart of FIG. 4C, is employed to account for the same.

If an attempt to eject a card near the top of the card stack fails, the shuffler assumes said failure is due to the difference between the actual and perceived number of cards. The adaptive method is activated in response to the shuffler detecting, at step 400, a difference between the actual number of cards and the perceived number of cards. Upon such detection, at step 410, the card stack is moved below a selected solenoid 31 and an ejector motor is turned off to disable the roller mechanisms 34A, 34B. The card input unit 10 is then, at step 420, incrementally raised in conjunction with the firing of the selected solenoid 31 until a top card is ejected 430. Once the solenoid 31 partially ejects the top card, at step 440, the position of the card deck is recorded and based on said recording, the actual number of cards is calculated. The calculation relies on the location of the top card, the previously measured and/or stored card thickness or deck thickness and the previously calibrated location of the bottom of the card stack. At step 450, the packer arms 35A, 35B pack the card back into the stack. At step 460, the motor is turned on and the ejection process continues.

The roller mechanisms 34A, 34B are counter-rotated by a belt drive motor 51 in combination with two idler pulleys. Roller mechanism 34A contacts a first edge of a playing card, and roller mechanism 34B simultaneously contacts a second edge of a playing card. The distance between the roller mechanisms 34A, 34B is adjustable to account for different sized playing cards. A lever 55 protruding through the shuffler housing is joined to an eccentric sleeve 56 by a linkage member 57. The eccentric sleeve 56 is positioned below the roller mechanism 34A and may be raised in response to actuation of lever 55 thereby decreasing the distance between the roller mechanisms 34A, 34B. The adjustability of the roller mechanisms 34A, 34B prevents damage to the cards in any manner. It is imperative that cards not be damaged since damaged cards provide skilled players with an unfair advantage over the casino.

Although the occurrence of card jams is difficult to eliminate, the design of the shuffler drastically reduces and, in fact, minimizes the occurrence of card jams. Preventative measures include rotatable packer arms 35A, 35B and de-doublers 36. The de-doublers 36 are integrated into a de-doubler frame 37 having a plurality of horizontal slots 38 (shown in FIG. 5) for ejected cards to pass through. Each slot 38 incorporates a de-doubler in the form of two vertically-spaced rubber elements 36 arranged in close proximity to prevent more than one ejected card from simultaneously passing through each horizontal slot 38.

In addition, two rotatable card packer arms 35A, 35B are placed adjacent the card input unit 10 adjacent a card eject area and opposite the placement of the solenoids 31. Sensors above and below a leading edge 99 of the card input unit 10 sense the protrusion of any cards from the card input unit 10. In response to the detection of protruding cards, the shuffler microprocessor causes the packer arms 35A, 35B to rotate in the direction of the leading edge 99 of the card input unit thereby forcing the protruding cards back into the proper alignment with the remaining cards in the stack. Each packer arm 35A, 35B is physically joined to a single rotary solenoid 41 by a linkage system. A first linkage member 42 is joined to a first arm of a triangular-shaped joint 43 that is rotatably attached to said rotary solenoid 41. A second end of linkage member 42 attaches to the first packer arm 35A. Second and third linkage members 44, 45 are connected by a triangular-shaped rotatable joint 46 spaced from said rotary solenoid 41. A first end of second linkage member 44 is attached to a second arm of the triangular-shaped joint 43 and a second end is attached to one corner of the rotatable joint 46. The third linkage member 45 is connected to a second opposite corner of the rotatable joint 46 and extends parallel to linkage member 42. The second end of the third linkage member 45 attaches to the second packer arm 35B. As the rotary solenoid 41 is instructed by the shuffler microprocessor to partially rotate in the clockwise direction, the linkage members 42, 45 each force one packer arm 35A, 35B to rotate toward the leading edge 99 of the card input unit 10. The packer arms 35A, 35B each rotate about a pivot 47A, 47B respectively and strike any protruding cards thereby forcing them back into the card stack.

Depending on the environment and the condition of the cards in the shuffler, the operation of the packer arms 35A, 35B may be less than ideal. Thus, a system for automatically addressing both the environment and the condition of the cards is beneficial. In one embodiment, the operation of the packer arms 35A, 35B is based on previous successes and/or failures of the packer arms 35A, 35B. Such successes and failures are measured by sensors above and below the leading edge 99 of the card input unit 10. The sensors sense the undesired protrusion of cards from the card input unit 10. If such card protrusions are present after the packer arms 35A, 35B have been activated, the packer arms 35A, 35B have failed to accomplish their objective. If not, the packer arms 35A, 35B have succeeded in accomplishing their objective. By adjusting a pulse length to solenoid 31, the action of the packer arms 35A, 35B may be adjusted automatically in response to one or more previous packer arm 35A, 35B activations. In other words, more or less energy may be needed to effectively pack protruding cards. Likewise, the number of activations of the packer arms 35A, 35B may also require adjusting based on the previous number of activations and successes and/or failures.

Now referring to FIGS. 5–8A, the card separation and delivery unit 70 is defined by a shuffler frame 2 defines the general shape of the shuffler and includes walls and a card-traveling surface 4 for guiding cards from the card input unit 10 to the card collection unit 110. Cards ejected by the ejection unit 30 traverse a fifteen degree downwardly inclined card-traveling surface 4 and encounter a rotatable U-shaped stop arm 57 blocking an entrance to the card separation and delivery unit 70. The stop arm 57 is spring loaded about pins 58 so that a first end of the stop arm 57 contacts the card-traveling surface 4 temporarily halting the progress of the cards. The shape of the stop arm 57 is such that it facilitates the removal of any cards which may get jammed in the area of the stop arm 57. The cards reaching the stop arm 57 collect and form a stack therebehind. Importantly, the stop arm 57 is positioned such that the stack is staggered to prevent excess cards from passing under the stop arm 57 when the stop arm 57 is briefly and intermittently raised as described below.

A rotatable guide cover 8 resides along an upper section of the frame 2 such that it covers the card-traveling surface 4 from the de-doubler frame 37 to a front portion of the stop arm 57. A forward end of the guide 8 is rotatably joined to the frame 2, and the rear end is releasably engaged, when closed, to magnet 9 attached to an outer surface of the frame 2 rear of the stop arm 57. The guide 8 functions to navigate ejected cards to the stop arm 57 by forming a chamber with the card-traveling surface 4.

The stop arm 57 is motor (not shown) and cam 59 driven whereby the stop arm 57 is intermittently raised from the card-traveling surface 4 allowing a predetermined number of cards to pass. A first one of the pins 58 communicates with a toggle member 60, cam 59 and spring 61 arrangement mounted to an external surface of said frame 2. As the cam 59 is rotated by the motor, a cam node 66 engages and rotates said toggle member 60 thereby causing the stop arm 57 to raise as long as the engagement continues. Once the cam node 66 disengages said toggle member 60 the stop arm 57 is returned to its original position by the spring 61 attached between the toggle member 60 and an elongated extension 63. The rotation of cam 59 is facilitated by pulley 64 and belt 65. The microprocessor controls the timing of the card stop arm 57 by controlling the time of engagement between the cam node 66 and the toggle member 60.

A system of rotatable belts incorporated in a cut-out section 66 of said card-traveling surface 4 and corresponding rollers provide means for propelling the cards from underneath the lifted stop arm 57 to the card separation and delivery unit 70 and ultimately the collection unit 110.

Three parallel and spaced belts 67-1, 67-2 and 67-3 reside slightly above the planar card-traveling surface 4. More or less than three belts may accomplish the same objective. Now referring to FIG. 8A, three belt pulleys 68-1, 68-2, 68-3 support said spaced belts 67-1, 67-2, 67-3 from underneath the card-traveling surface 4. The front pulley 68-3 is adjustable, in the forward and rear direction, to account for differences in manufactured belts and belt stretching. As cards pass under the lifted stop arm 57, a first end of the rotating belts 67-1, 67-2, 67-3, in combination with two upper separation rollers 69, act to remove and advance only a bottom card from the pack. The upper separation rollers 69 are spring-biased and supported by a first non-rotating shaft 72. Once a card passes between the separation belts 67-1, 67-2, 67-3 and separation rollers 69, the rollers 69 begin to stop rotating since they are no longer being acted upon by the rotating separation belts 67-1, 67-2, 67-3. Additionally, springs 73 provide friction to more hurriedly impede the movement of rollers 69 thereby causing rollers 69 to clutch all but the bottom card in the pack. A nub 90 integrated into a split of the middle belt pulley 68-2 contacts the lower most card in the stack so as to encourage the lower most card in the stack to separate from the stack. Preferably, the nub 90 operates on the bottom most card of the stack one time per revolution of the belt pulley 68-2.

Preferably, a centerline of the middle belt pulley 68-2 is slightly forward of a centerline of the separation rollers 69 so that a trailing edge of each passing card is forced downward by said rollers 69 thereby preventing the next passing card from becoming situated thereunder.

A floating gate 74 is supported by an elongated member 75 fixed at one end to the shaft 72 and a second parallel floating gate shaft 74B spaced forward of the separation roller shaft 72. The floating gate 74 includes a protrusion 74A extending downwardly to prevent more than three cards from fully passing under the stop arm 57 at any given time. In this arrangement, the belts 67-1, 67-2, 67-3 and the rollers 69 only have to manage small (e.g. three) card stacks. Thus, the risk of more than one card being propelled to the card collection unit 110 and causing a misdeal is eliminated. Moreover, the floating gate 74 also controls card jams.

As the cards pass under the floating gate 74 they are propelled by the belts 67-1, 67-2, 67-3 to a pair of upper feed rollers 76 and lower feed rollers 77 which counter-rotate to expel individual cards into the collection unit 110. The upper and lower feed rollers 76, 77 grab opposite surfaces (e.g. the face and back of the card as it traverses the card-traveling surface 4) of each card and propel the card into the collection unit 110. The upper feed rollers 76 are supported by a non-rotating parallel feed shaft 79. The lower feed rollers 77 are driven at a higher speed than belts 67-1, 67-2, 67-3 and rollers 69 so as to create separation between the trailing edge of a first card and the leading edge of a following card. As described below, it is the card separation space that sensors count to verify the number of cards fed into the collection unit 110.

The belts 67-1, 67-2, 67-3 and lower rollers 77 are both driven by a common motor, timing belt and pulley system. A system of three pulleys 85-1, 85-2, 85-3 and a timing belt 86 are mounted on an external surface of the shuffler frame 2 and are driven by a common internal motor. The lower feed rollers 77 are acted upon by pulley 85-2 having a smaller diameter than pulley 85-1 that acts upon belts 67-1, 67-2, 67-3 thereby creating a differential in rotational speeds.

Once the separated cards pass the between rollers 76, 77 they are delivered to the card collection unit 110. The collection unit 110 is inclined downwardly fifteen degrees so that the cards settle at the front of the collection unit 110 for easy retrieval by a dealer.

The separation shaft 72, floating gate shaft 74B, feed shaft 79, separation rollers 69 and upper feed rollers 76 are joined by two pair of elongated bars. A first set of bars 81-1, 81-2 rotatably join the outer portions of the separation shaft 72 to the outer portions of the floating gate shaft 74B. A second set of bars 82-1, 82-2 join the floating gate shaft 74B to the outer portions of the feed roller shaft 79. The floating gate shaft 74B is further supported by opposite notches 83 in the frame 2. In this manner, card jams may be physically cleared by an operator by lifting the floating gate shaft 74B thereby causing the separation shaft 72 to move forward and upward. An open slot 84 in the elongated member 75 further allows the elongated member 75 to be rotated away from the floating gate shaft 74B revealing the card separation and delivery unit 70 for card removal. Springs 87 incorporated between outer surfaces of said first bars 81-1, 81-2 and inner surfaces of the frame 2 return the floating gate shaft 74B to its original position after a card jam is cleared.

Multiple sensors are incorporated throughout the shuffler to track the progression of the cards, inform an operator of shuffler status and to alert the operator of any internal problems. A first, preferably optical reflective, sensor 125 is positioned beneath the card input unit 10 to sense the input of cards into the unit 10. During normal operation the shuffler will not function until sensor 125 detects the presence of cards in card input unit 10. A first pair of sensors (emitter and detector) above and below a leading edge of the card input unit 10 senses the presence of protruding cards from within the card input unit 10. The shuffler microprocessor activates the packer arms 35A, 35B in response to outputs from the first pair of sensors.

A second pair of sensors spaced forward of the first pair of sensors detects the ejection of cards from the card input unit 10. The second pair of sensors detects the number of ejected cards. The number of cards ejected is predetermined based on the underlying card game being dealt. The shuffler microprocessor stops the ejection process once outputs from the second pair of sensors indicate that two hands of cards have been ejected. The number of cards per hand is a function of the underlying wagering game being played. As described below, the shuffler microprocessor re-starts the ejection process in response to an output from a more forward pair of sensors.

Once two hands of cards have been ejected from the card input unit 10, they come to rest, in a staggered stacked fashion, against or adjacent to the card stop arm 57. As the second pack is completely delivered to the card stop arm 57, outputs from the second pair of sensors inform the shuffler microprocessor that the two hands have been ejected and to lift said stop arm 57. The raising of the stop arm 57 permits the previously ejected cards to partially pass under the stop arm 57 to the floating gate 74. Thereafter, the belts 67-1, 67-2, 67-3 and rollers 76, 77 propel the bottom card of the stack to the card collection unit 110 until a first hand has been fed to the card collection unit 110. A third pair of sensors 141, 142 are located adjacent a card exit area such that the pair of sensors 141, 142 detects the number of cards being delivered to the card collection unit 110. Once a first hand is delivered to the card collection unit 110, the shuffler microprocessor, using outputs from the third pair of sensors, stops delivering cards to the card collection unit 110 and re-starts the ejection process. A fourth pair of sensors 143, 144, located in the collection unit 110 detects the presence or absence of cards therein. Once a dealer removes the first card hand from the collection unit 110, the shuffler microprocessor, using outputs from the fourth pair of sensors 143, 144 resumes delivering cards to the card collection unit 110.

The sensor and shuffler microprocessor driven process described continues until the requisite number of hands are delivered to the card collection unit 110 and distributed by the dealer. Once the requisite number of hands has been delivered and dealt, the dealer presses a stop button on the shuffler to stop further card delivery. In an alternative fashion, the shuffler housing may incorporate a re-eject button that the operator may press prior to each hand being ejected. In either embodiment, the ejection unit 30 only need deal the exact number of cards required for the game and number of players playing the game. Thereafter, the ejection technology allows the operator to simply place the played cards on top of the remaining cards in the card input unit 10 and press the go button for the next game. Previous card shufflers require that all cards be shuffled and delivered for each game played. The random ejection technology of the present invention greatly reduces the time between game plays.

Additional sensors are placed along the card separation and delivery unit 70 to detect the occurrence of a card jam or other dealing failure. Upon the determination that a card jam has occurred, the operator can be notified in any number of ways, including the use of LED indicator lights, segmented and digital displays, audio outputs, etc. In one embodiment, the present invention relies on audio outputs in the form of computer generated voice outputs to alert the operator of a card jam or to instruct the operator regarding the status of the shuffler.

In one embodiment, a display unit (not shown) displays a hierarchical menu which provides menu items for an operator to interact with the shuffler. Such a menu is designed to be quickly navigated so that an operator is able to locate the desired shuffler command or information. Ideally, multiple buttons are used to interact with the menu. Optionally, a single button (not shown) is used to both navigate and scroll through a series of the displayed menu items and to select a desired menu item. In the single button embodiment, the duration of the button depression dictates whether navigation or selection is achieved. For example, navigation may be achieved by button depressions of between 30 milliseconds and 2 seconds. Selection of a menu item may then be achieved by button depressions in excess of 2 seconds. In this manner, the menu may be navigated with quick depressions of the single button.

As set forth above, the preferred method of notifying a shuffler operator of a card jam or the status of the current shuffle cycle is through an internal audio system. Now referring to FIG. 9, the audio system utilizes a second microprocessor 151, preferably a 32-bit microprocessor, interfaced with the shuffler microprocessor 150. The preferred interface 152 is an RS-232 bi-directional interface. The second microprocessor 151 runs the audio system and a video capture imaging system fully described in co-pending patent application Ser. No. 10/067794 to the same assignee as the instant application and incorporated herein by reference.

A flash storage card 153 stores digital audio messages, in any language, and communicates said messages to the second microprocessor through a 32-bit bus 154. The messages are retrieved by the second microprocessor 151 in response to commands by microprocessor 150. Microprocessor 150 relies on the outputs of the multiple shuffler sensors for instructing the second microprocessor 151. For example, should a sensor detect a card jam, the output of said sensor will cause microprocessor 150 to communicate with microprocessor 151 instructing the latter that an audio message is required. Microprocessor 151 will then retrieve the appropriate message, possibly a message stating "CARD JAM", from the flash storage card 153 and send the same to a codec 154 (coder-decoder) for converting the retrieved digital audio signal to an analog signal. The analog audio signal is then transmitted via a speaker 155.

The microprocessor 150 also communicates to a flash programmable gate array 157 through a second 32-bit bus 158. The gate array 157 further communicates with a repeat switch 159 incorporated with the shuffler housing. The switch 159 allows an operator to re-play the previous audio message. Said feature is beneficial during shuffler use in a loud casino environment.

It is contemplated that stored audio messages besides "CARD JAM" may include "READY TO SHUFFLE", "REMOVE FIRST HAND", "REMOVE SECOND HAND", "INPUT CARDS", etc. The number of possible audio messages depends solely on the various sensor outputs since the sensors provide microprocessor 150 with the status of the shuffler at any given time. In a more limited application the audio system can be used to communicate game related information, to an operator. For example, the card game known as Pai Gow requires that a number between 1 and 7 be randomly chosen prior to the deal of the game's first hand. The random number determines which player position, and therefore which player, receives the first hand out of the shuffler. Typically dice or random number generators in communication with a display means have been used to generate and communicate the random number to an operator and players. The audio system allows the microprocessor 150 to randomly generate a number between 1 and 7, communicate the number to microprocessor 151, which sends the number to the codec 154, which causes speaker 155 to output the number in audio form. The repeat switch 159 is very useful in this limited application because the number is absolutely essential to properly play the game of Pai Gow. Therefore, the inability to re-play an unheard or disputed number would cause great confusion and consternation for players.

Figure 9:
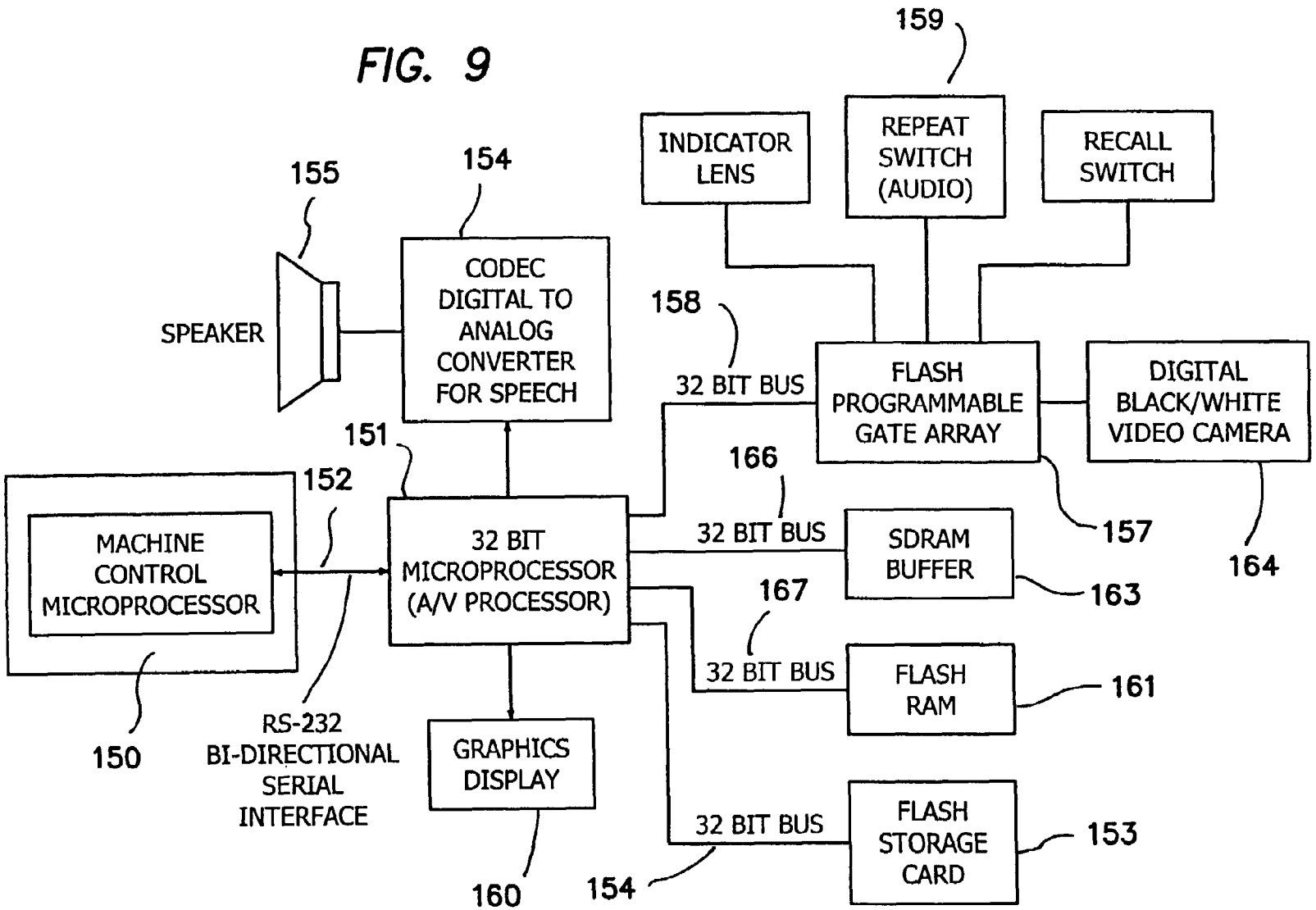
FIG. 9 is a block diagram showing an audio output system of the present invention.

Also illustrated in FIG. 9 are the various components of the image capturing system, including a graphics display 160, flash ram 161, SDRAM buffer 163, digital (black/white) video camera 164 and hand recall switch 165. The flash ram 161 initially stores digital images of every dealt card as they are captured by the digital camera 164. The SDRAM buffer 163 then stores and assembles the captured images. The images captured by the digital camera 164 are sent to the gate array 157 which uses gray scale compression to compress the images. The compressed images are then sent via 32-bit bus 158 to microprocessor 151 which then sends the compressed images to the SDRAM buffer and/or the flash memory 161 via 32-bit buses 166, 167. When desired the operator presses the hand recall switch 165 incorporated in the shuffler housing to display the captured images, in order of deal, on display 160.

Although the operation of the shuffler has heretofore been controlled by a processor relying on a single large state machine, this method is limiting, in that only single tasks may be achieved at one time. A multi-tasking operating system would allow multiple tasks to be accomplished simultaneously, but would require more robust computing capability than is appropriate for a simple embedded controller such as that used with a card shuffling device. In the alternative, the shuffler is also capable of being formed of a group of interlocking state machines or modules. For example, a state machine system may facilitate a shuffler state, a dealer state and a shuffler or ejection state. The states of the various modules are communicated with one another so that each module operates in an efficient and timely fashion. The state system also provides a means for debugging individual modules rather than debugging the entire shuffler.

Although the invention has been described in detail with reference to a preferred embodiment, additional variations and modifications exist within the scope and spirit of the invention as described and defined in the following claims.

We claim:

1. A method of shuffling cards comprising:

selecting a random position, corresponding to a specific single card, from a stack of playing cards placed in a card input unit;

determining the positional height of the specific single card within the stack of playing cards;

selecting a solenoid and corresponding ejector blade;

aligning the single specific card and the selected solenoid; and firing said selected solenoid causing the ejector blade to eject the specific single card from the stack.

2. The method of claim 1 further comprising selecting the solenoid based on its proximity to the specific single card.

3. The method of claim 1 further comprising aligning the specific single card and the solenoid by manipulating a position of the card input unit.

4. The method of claim 1 wherein the step of firing said solenoid causing the ejector blade to eject the specific single card from the stack further comprises:

firing said solenoid such that said ejector blade is substantially stopped when nearing contact with the specific single card; and firing said solenoid a second time to generally push the single specific card from the stack.

5. The method of claim 1 further comprising measuring a thickness of a complete deck of cards in the card input unit and calculating an average card thickness.

6. The method of claim 5 further comprising storing the average card thickness in a shuffler memory device.

7. The method of claim 1 further comprising initially calibrating each solenoid.

8. The method of claim 7 wherein initially calibrating each solenoid comprises:

a. positioning the card input unit above all solenoids;

b. incrementally lowering said card input unit activating an uppermost solenoid;

c. determining from sensor that a top card has been partially ejected;

d. repeating steps a–c for each solenoid; and e. storing location values corresponding to each solenoid.

9. The method of claim 1 further comprising applying a force or mass to the cards in the card input unit so that said cards are substantially compressed.

10. A method of shuffling cards comprising:

detecting that a number of cards in a card input unit is less than a theoretical number of cards which should be, based on ideal shuffler operation, in the card input unit;

positioning the card input unit and a card stack below a selected solenoid and corresponding ejector blade;

incrementally raising the card input unit in concert with firing the selected solenoid causing the ejector blade to attempt to at least partially eject a top card from the card stack until the top card is at least partially ejected;

in response to the top card being at least partially ejected, recording the position of the card stack; and based on the card stack position, calculating the number of cards remaining in the card input unit.

11. The method of claim 10 further comprising initially storing in a shuffling machine memory device an average card thickness.

12. The method of claim 10 further comprising initially selecting a card thickness from a plurality of card thicknesses stored in a shuffling machine memory device.

13. The method of claim 10 further comprising measuring a thickness of a complete deck of cards in the card input unit and calculating an average card thickness.

14. The method of claim 13 further comprising storing the average card thickness in a shuffler memory device.

15. The method of claim 10 further comprising applying a force or mass to the cards in the card input unit so that said cards are substantially compressed.

16. A method of shuffling cards comprising:

randomly ejecting cards from a card stack by continuously activating one or more ejector blades;

after each activation of the ejector blades, determining whether any cards are in an undesirable orientation in the stack;

activating one or more packer arms to properly position any cards in an undesirable orientation;

determining whether or not the activation of the packer arms has properly positioned the cards which were determined to be in an undesirable orientation; and automatically adjusting the operation of the packer arms in response to the determination of whether or not the activation of the packer arms has properly positioned the cards in an undesirable orientation.

17. The method of claim 16 further comprising adjusting the the packer arms by increasing or decreasing the frequency of activations and increasing or decreasing the strength of the activations.

18. A method of shuffling cards comprising:

randomly ejecting cards from a card stack by continuously activating one or more ejector blades;

calculating a speed of one or more cards as they exit the card input unit;

comparing the calculated speed with a minimum threshold speed stored in a shuffling machine memory device; and in response to the calculated speed being below the minimum threshold speed, notifying an operator that the playing cards need to be replaced.

19. The method of claim 18 further comprising recording a number of times that more than one card is ejected by a single strike of one or more of the ejector blades and in response to the recorded number exceeding a stored threshold number, notifying an operator that the playing cards need to be replaced.

20. The method of claim 18 further comprising applying a force or mass to the cards in the card input unit so that said cards are substantially compressed.

* * * * *